US005728235A

United States Patent [19]

Boulos et al.

[11] Patent Number: 5,728,235

[45] Date of Patent: Mar. 17, 1998

[54] MODERATE TEMPERATURE MANGANESE PHOSPHATE CONVERSION COATING COMPOSITION AND PROCESS

[75] Inventors: Mervet S. Boulos, Troy; David C. Montrose, St. Clair Shores; Michael Petschel, Rochester Hills, all of Mich.

[73] Assignee: Henkel Corporation, Plymouth Meeting, Pa.

[21] Appl. No.: 747,136

[22] Filed: Nov. 12, 1996

Related U.S. Application Data

[63] Continuation-in-part of Ser. No. 601,481, Feb. 14, 1996, Pat. No. 5,595,611.

[51] Int. Cl.[6] ..... C23C 22/18

[52] U.S. Cl. ..... 148/257; 148/262

[58] Field of Search ..... 148/262, 259

[56] References Cited

U.S. PATENT DOCUMENTS

| | | | |
|---|---|---|---|
| 1,206,075 | 11/1916 | Allen . | |
| 1,639,694 | 8/1927 | Green et al. . | |
| 2,132,000 | 10/1938 | Curtin | 148/6.5 |
| 2,375,458 | 5/1945 | Agnew et al. | 256/10 |
| 2,668,496 | 2/1954 | Thompson | 101/178 |
| 3,562,023 | 2/1971 | Courier | 148/6.15 |
| 3,767,476 | 10/1973 | Wagner et al. | 148/6.15 R |
| 3,860,455 | 1/1975 | Hansen et al. | 148/6.15 R |
| 4,717,431 | 1/1988 | Knaster | 148/262 |
| 4,849,031 | 7/1989 | Hauffe | 148/262 |
| 4,941,930 | 7/1990 | Charles et al. | 148/260 |
| 5,000,799 | 3/1991 | Miyawaki | 148/259 |
| 5,045,130 | 9/1991 | Gosset et al. | 148/257 |
| 5,261,973 | 11/1993 | Sienkowski et al. | 148/262 |
| 5,372,656 | 12/1994 | Riesop | 148/262 |
| 5,472,522 | 12/1995 | Kawaguchi | 148/262 |

FOREIGN PATENT DOCUMENTS

| | | | |
|---|---|---|---|
| 752345 | 2/1967 | Canada | 148/259 |
| 81-23882 | 7/1983 | Japan . | |

OTHER PUBLICATIONS

M. Hamacher, "Ecologically Safe Pretreatments of Metal Surfaces", *Henkel Referate* 30 (1994), pp. 138–143.

*Primary Examiner*—Sam Silverberg

*Attorney, Agent, or Firm*—Wayne C. Jaeschke; Norvell E. Wisdom, Jr.; Frank E. Robbins

[57] ABSTRACT

An aqueous solution of manganese phosphate and phosphoric acid, preferably with little or no content of any material conventionally recognized as an accelerator or of any divalent metal ions other than manganese and iron, forms a good quality paint undercoating phosphate conversion coating on metal substrates, particularly on steel and galvanized steel substrates, when contacted by spraying or immersion with the substrates at a temperature of 54°–65° C. for a time of 0.5–5 minutes.

6 Claims, No Drawings

MODERATE TEMPERATURE MANGANESE PHOSPHATE CONVERSION COATING COMPOSITION AND PROCESS

CROSS-REFERENCE TO RELATED APPLICATION

This application is a continuation-in-part of application Ser. No. 08/601,481 filed on Feb. 14, 1996 now U.S. Pat. No. 5,595,611.

BACKGROUND OF THE INVENTION

1. Field of the Invention

This invention relates to compositions and processes for depositing a manganese containing phosphate conversion coating on metal surfaces, particularly the surfaces of ferrous metals, galvanized steel, and other predominantly zinciferous surfaces. The invention particularly relates to such compositions and processes that produce, at a temperature not more than 80° C., a conversion coating suitable as a high quality undercoat for paint and like organic coatings.

2. Statement of Related Art

The general process of phosphate conversion coating is well known in the art. See, e.g., M. Hamacher, "Ecologically Safe Pretreatments of Metal Surfaces", *Henkel-Referate* 30 (1994), pp. 138–143, which, except to the extent that it may be contrary to any explicit statement herein, is hereby incorporated herein by reference. In brief, contact of active metals such as iron and zinc with aqueous acidic compositions containing a sufficient concentration of phosphate ions results in the deposition on the active metal surfaces of a conversion coating containing phosphate ions and some metallic cations, which are derived from dissolution of the active metal being phosphate conversion coated, from metallic cations with a valence of at least two that are present in the aqueous acidic compositions, or both. In many instances, particularly when the phosphating compositions contain zinc, nickel, or manganese, in order to speed the process and improve the uniformity of the coating, it is customary to include in the coating composition a component called an "accelerator" that does not usually become incorporated into the coating formed. Typical widely used accelerators include nitrite and chlorate ions, water soluble nitroaromatic organic compounds such as p-nitrobenzene sulfonic acid, and hydroxylamine, the latter almost always in the form of salts or complexes and different from most other accelerators because, in the concentrations in which it is normally used, it is not a strong enough oxidizing agent to oxidize Fe(II) ions to Fe(III) ions, one of the functions of most other accelerators.

Prior art phosphating compositions that include manganese as substantially the only metal cations with a valence of two or more in the compositions have been known and used. However, such compositions have been previously used in practice only at relatively high temperatures, almost always above 80° C. and more often above 88° C. Such compositions have been notoriously prone to sludging, a phenomenon that occurs with almost all phosphate conversion coating compositions but is quantitatively aggravated when the compositions contain manganese as the predominant cations with a valence of two or more.

Furthermore, such prior art manganese based conversion coatings have been normally used only to deposit thick and usually macrocrystalline conversion coatings that function primarily as lubricant carders during cold working of the metal objects underlying the conversion coatings formed.

Although this is one important practical application of phosphating, providing an undercoat for paints is still more important and in the past has not been advantageously accomplished by phosphating compositions in which divalent manganese ions were substantially the only metal cations present with a valence of two or more. The thick phosphate conversion coatings readily achieved with manganese phosphating compositions are too thick and/or brittle to provide good adhesion to subsequently applied paint and like materials, presumably because thick manganese phosphate coatings are readily cracked by even fairly small mechanical shocks. On the other hand, controlling manganese phosphating compositions to produce thinner, usually microcrystalline, types of phosphate conversion coatings, which do provide good adhesion to subsequently applied paint and which are readily produced by phosphating compositions that contain zinc, nickel, cobalt, and/or iron in a total amount of at least 0.5 grams per liter (hereinafter usually abbreviated as "g/L"), has proved to be practically difficult if not impossible with manganese phosphating compositions.

Also, prior art manganese phosphating compositions are not known to have produced satisfactory quality conversion coatings when contacted with the surfaces to be coated by spraying only, and have generally been used only when the surfaces to be coated were immersed in the compositions.

DESCRIPTION OF THE INVENTION

Object of the Invention Various alternative and/or concurrent objects of this invention are: (i) to provide a composition and process for phosphating that will provide a high quality protective undercoat for paint and like organic binder containing overcoatings, where manganese ions are the predominant cations with a valence of two or more in the composition; (ii) to provide manganese containing phosphate conversion coatings readily controlled to lower coating masses of manganese per unit area coated than have been usual with prior art manganese phosphate conversion coating compositions; (iii) to provide relatively economical phosphate conversion coating compositions and processes that will provide as good quality paint undercoatings as do currently conventional phosphate conversion coating processes utilizing zinc, nickel, and/or cobalt containing conversion coating forming compositions; (iv) to provide conversion coatings with good paint undercoating quality by spraying; (v) to reduce the pollution hazard from phosphating compositions by (v.1) reducing or eliminating their content of zinc, nickel, cobalt, chromium, copper, and/or other "heavy metals" other than manganese and/or (v.2) decreasing volumes of sludge formed during use of the phosphating compositions; and (vi) to provide conversion coatings with good paint undercoating quality at a phosphating temperature not greater than 70° C. Other objects will be apparent from the description below.

General Principles of Description

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred, however. Also, throughout the specification, unless expressly stated to the contrary: percent, "parts of", and ratio values are by weight; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description, and does not necessarily preclude chemical interactions among the constituents of a mixture once mixed; specification of materials in ionic form implies the presence of sufficient counterions to produce electrical neutrality for the composition as a whole; any counterions thus implicitly specified should preferably be selected from among other constituents explicitly specified in ionic form, to the extent possible; otherwise such counterions may be freely selected, except for avoiding counterions that act adversely to the object(s) of the invention; the terms "molecule" and "mole" and their grammatical variations may be applied to ionic, elemental, or any other type of chemical entities defined by the number of atoms of each type present therein, as well as to substances with well-defined neutral molecules; the first definition of an acronym or other abbreviation applies to all subsequent uses herein of the same abbreviation and applies mutatis mutandis to normal grammatical variations of the initially defined abbreviation; the term "paint" includes all like materials that may be designated by more specialized terms such as lacquer, enamel, varnish, shellac, and the like; and the term "polymer" includes "oligomer", "homopolymer", "copolymer", "terpolymer", and the like.

SUMMARY OF THE INVENTION

It has been found that one or more of the objects stated above for the invention can be achieved by the use of a conversion coating forming aqueous liquid composition that has a pH of at least 3.0 and comprises, preferably consists essentially of, or more preferably consists of, water and:

(A) dissolved divalent manganese cations; and (B) dissolved phosphate anions; and, optionally, one or more of the following:

(C) a component of dissolved acids that are not part of any of the previously recited components;

(D) a dissolved component selected from the group consisting of organic acids and anions thereof that (1) contain at least two moieties per molecule that are selected from the group consisting of (i) carboxyl and carboxylate moieties, (ii) hydroxyl moieties that are not part of a carboxyl moiety, and (iii) phosphoric acid and phosphonate moieties and (2) are not part of any of the previously recited components;

(E) a component of dissolved reducing agent and/or reaction products therefrom that are not part of any of the previously recited components;

(F) a component of surfactant that is not part of any of the previously recited components;

(G) a dissolved component selected from the group consisting of simple and complex anions that contain fluorine atoms and are not part of any of the previously recited components;

(H) a component of dissolved metal cations, with a valence of at least two, that are not part of any of the previously recited components;

(J) buffering agents that are not part of any of the previously recited components; and (K) biocides that are not part of any of the previously recited components.

Various embodiments of the invention include working compositions for direct use in treating metals, make-up concentrates from which such working compositions can be prepared by dilution with water, replenisher concentrates suitable for maintaining optimum performance of working compositions according to the invention, processes for treating metals with a composition according to the invention, and extended processes including additional steps that are conventional per se, such as cleaning, activation of the surface to be conversion coated before it is contacted with the conversion coating composition (e.g., activation of steel with titanium phosphate sols, also known as "Jernstedt salts"), rinsing, and subsequent painting or some similar overcoating process that puts into place an organic binder containing protective coating over the metal surface treated according to a narrower embodiment of the invention. Articles of manufacture including surfaces treated according to a process of the invention are also within the scope of the invention.

DESCRIPTION OF PREFERRED EMBODIMENTS

For a variety of reasons, it is sometimes preferred that compositions according to the invention as defined above should be substantially free from many ingredients used in compositions for similar purposes in the prior art. Specifically, when maximum storage stability of a concentrate, avoidance of possibly troublesome anions, economy, and/or minimization of pollution potential is desired, it is preferred, with increasing preference in the order given, independently for each preferably minimized component listed below, that these compositions contain no more than 25, 15, 9, 5, 3, 1.0, 0.35, 0.10, 0.08, 0.04, 0.02, 0.01, 0.001, or 0.0002, percent of each of the following constituents: nitrite; halates and perhalates (i.e., perchlorate, chlorate, iodate, etc.); hydroxylamine and salts and complexes of hydroxylamine; chloride; bromide; iodide; organic compounds containing nitro groups; hexavalent chromium; manganese in a valence state of four or greater; metal cations, other than manganese and iron, with a valence of two or more; ferricyanide; ferrocyanide; and pyrazole compounds. Components such as these may not be harmful in some cases, but they have not been found to be needed or advantageous in compositions according to this invention, and their minimization is therefore normally preferred at least for reasons of economy. Further and independently, in contrast to most other phosphating compositions and processes, it is preferred that working phosphating compositions according to this invention should have an oxidizing power no greater than that which is inherent in an otherwise preferred composition according to the invention, with other ingredients explicitly specified as necessary or preferred, that is in equilibrium with the natural atmospheric gases. The oxidizing power of the composition may be measured for this purpose by the potential of a platinum electrode immersed in the composition, compared to some standard reference electrode maintained in electrical contact with the composition via a salt bridge, flowing junction, semipermeable membrane, or the like as known to those skilled in electrochemistry.

The dissolved manganese cations required for necessary component (A) may be obtained from any soluble manganese salt or from manganese metal itself or any manganese containing compound that reacts with aqueous acid to form dissolved manganese cations. Normally preferred sources, largely for economic reasons, are manganese carbonate and manganese oxide. (If manganese oxide is used to prepare a concentrate composition according to the invention, the presence of reducing agent component (E) as defined above is usually preferred, because without it the dissolution rate of MnO in phosphoric acid is very slow. Reducing agents appear to act in a catalytic or at least partially catalytic manner to speed the dissolution process, inasmuch as the amount of reducing agent needed to make the dissolution rate of MnO practically fast is far less than the amount that would be stoichiometrically required to react with all the manganese present.)

In a working conversion coating forming aqueous liquid composition according to the invention, the concentration of dissolved manganese cations preferably is at least, with increasing preference in the order given, 0.1, 0.2, 0.30, 0.40, 0.50, 0.60, 0.70, 0.80, 0.90, 1.00, 1.10, 1.20, 1.30, 1.35, 1.40, 1.45, or 1.49 parts per thousand (hereinafter usually abbreviated as "ppt") and independently preferably is not more than, with increasing preference in the order given, 4.0, 3.5, 3.0, 2.7, 2.5, 2.3, 2.2, 2.1, or 2.0 ppt. Smaller concentrations than those recited as preferred minimums above generally do not produce satisfactory coatings in a reasonable time. Larger concentrations than those recited as preferred maximums above generally do not produce any quality improvement in the coatings formed and are therefore uneconomical.

The dissolved phosphate ions that constitute necessary component (B) also may be obtained from a variety of sources as known in the general phosphate conversion coating art. Because of a preference noted below for a substantial amount of total acid in a working conversion coating forming aqueous liquid composition according to the invention, normally much of the phosphate ion content will preferably be supplied by phosphoric acid added to the composition, and the stoichiometric equivalent as phosphate ions of all undissociated phosphoric acid and all its anionic ionization products in solution, along with the stoichiometric equivalent as phosphate ions of any dihydrogen phosphate, monohydrogen phosphate, or completely neutralized phosphate ions added to the composition in salt form, are to be understood as forming part of component (B), irrespective of the actual degree of ionization that exists in the composition. If any metaphosphodc acid or condensed phosphoric acids or their salts are present in the compositions, their stoichiometric equivalent as phosphate is also considered part of component (B). Generally, however, it is preferred to use orthophosphoric and its salts only for component (B).

In a working conversion coating forming aqueous liquid composition according to the invention, the concentration of component (B) preferably is at least, with increasing preference in the order given, 5, 6, 7, 8, 9, 10, 10.5, 11.0, 11.5, 11.8, 12.0, 12.2, 12.4, or 12.6 ppt and independently preferably is not more than, with increasing preference in the order given, 100, 50, 40, 30, 27, 24, 21, 19.0, 18.0, 17.0, 16.0, 15.0, 14.0, 13.7, 13.3, 13.0, or 12.8 ppt.

Independently of the other preferences, the ratio of the concentration of component (A) to the concentration of component (B) in a conversion coating forming aqueous liquid composition according to the invention, whether working or concentrate, preferably is at least, with increasing preference in the order given, 1.0:50, 1.0:40, 1.0:35, 1.0:30, 1.0:27, 1.0:24, 1.0:21, 1.0:18, 1.0:16, 1.0:15, 1.0:14, or 1.0:13.7 and independently preferably is not more than, with increasing preference in the order given, 1.0:5.0, 1.0:6.0, 1.0:7.0, 1.0:8.0, 1.0:8.5, 1.0:9.0, 1.0:9.5, 1.0:10, 1.0:10.5, 1.0:11.0, 1.0:11.5, 1.0:12.0, 1.0:12.5, 1.0:13.0, or 1.0:13.3.

Nitric acid is preferably present in a composition according to the invention, most preferably as the major but not the sole constituent of component (C); other acids can also be present in the compositions according to the invention, either alone or with nitric acid. The major recognized purpose of most of component (C) is to increase the "Total Acid" content of compositions according to the invention above the levels that can be achieved with phosphoric acid alone without exceeding the above noted preferred maximum values for phosphate ions. The Total Acid content, consistent with general practice in the art, is measured in "points", which are defined for the purposes of this description to be equal to the milliliters ("ml") of 0.1N NaOH required to titrate a 10 ml aliquot sample of the composition to a pH of 8.2 (e.g., with phenolphthalein indicator).

The Total Acid points present in a working composition according to the invention preferably are at least, with increasing preference in the order given, 4, 6, 8, 10, 12.0, 13.0, 14.0, 14.5, 15.0, 15.3, 15.5, 15.7, or 15.9 and independently preferably are, primarily for reasons of economy, not more than, 50, 40, 35, 30, 25, 20, 18.0, 17.5, 17.0, 16.5, or 16.2.

The content of "Free Acid" of compositions according to the invention can also significantly affect their performance in forming high quality phosphate coatings. Points of Free Acid are defined in the same way as points of Total Acid, except that the titration is to a pH of 3.8 (e.g., with bromophenol blue indicator). If the pH of the composition is already 3.8 or greater, the titration is made with 0.1N strong acid instead of NaOH and is then described alternatively as negative Free Acid, or more commonly, as "Acid Consumer". Compositions according to the invention preferably have Free Acid points that are at least, with increasing preference in the order given, −1.5, −1.0, −0.80, −0.70, −0.60., −0.55, or −0.50 and independently preferably are not more than, with increasing preference in the order given, 1.5, 1.0, 0.80, 0.60, 0.50, 0.40, 0.30, 0.20, 0.15, or 0.10.

Another material that has been found useful as part of component (C) is formic acid, particularly in combination with nitric acid. In a working composition according to the invention, the concentration of formic acid preferably is at least, with increasing preference in the order given, 0.04, 0.08, 0.15, 0.20, 0.25, 0.30, 0.35, 0.39, or 0.43 g/L and independently, primarily for reasons of economy, preferably is not more than, with increasing preference in the order given, 5, 3.0, 2.0, 1.5, 1.0, 0.90, 0.80, 0.70, 0.65, 0.60, 0.55, 0.50, or 0.45 g/L. Independently of their actual concentrations, when both nitric and formic acids are present in a composition according to the invention, the ratio of the concentration of formic acid to the concentration of nitric acid preferably is at least, with increasing preference in the order given, 0.002, 0.004, 0.006, 0.008, 0.010, 0.015, 0.020, 0.023, 0.026, 0.029, 0.032, or 0.034:1.0 and independently preferably is not more than, with increasing preference in the order given, 0.5, 0.3, 0.20, 0.10, 0.080, 0.070, 0.060, 0.050, 0.045, 0.041, 0.038, or 0.036:1.0. The primary benefit observed from the presence of formic acid in compositions according to the invention is more rapid coating formation.

Component (D), one of the important functions of which when used is to sequester calcium and magnesium ions that might be present in the water supply, normally is not needed in compositions according to the invention unless they are to be diluted with very hard water. When used it is preferably derived from anions or other molecules each of which contains both at least one carboxyl(ate) moiety and one hydroxyl moiety that is not part of any carboxyl(ate) moiety, more preferably from the group consisting of citric acid, gluconic acid, and heptogluconic acid and the water soluble salts of all of these acids, most preferably from gluconic acid and its water soluble salts. Independently, when it is used at all, the concentration of component (D) in a working conversion coating forming aqueous liquid composition according to the invention preferably is at least, with increasing preference in the order given, 0.4, 0.8, 1.5, 2.0, 2.5, 3.0, 3.5, 4.0, 4.3, 4.6, 4.8, or 5.0 millimoles per liter of total composition (hereinafter usually abbreviated as "mM") and independently, primarily for reasons of economy, when it is used at all, the concentration of component (D) in a working composition according to the invention preferably is not more than, with increasing preference in the order given, 50, 25, 15, 10, 7.0, 5.8, 5.5, or 5.2 mM.

As already noted above, reducing agent component (E) is normally preferred in compositions according to the invention when concentrates are being made by dissolving MnO in phosphoric acid. If working solutions are being prepared directly, or some more readily soluble source of Mn(II) ions than MnO is used, component (E) is generally not needed. When component (E) is used, it is preferably selected from the group consisting of (i) hydroxylamine and salts, complexes, oximes, and other reaction products of hydroxylamine that, when dissolved in water, establish an equilibrium with free hydroxylamine and rapidly release more hydroxylamine when any already; released has been consumed by some irreversible reaction, so that these reaction products function chemically in the same manner as hydroxylamine itself when dissolved in water and (ii) ferrous ions, with the latter preferred, because they are less expensive and also effective in lower concentrations. Any water soluble salt of ferrous iron may be used as a source of ferrous ions, as may powdered metallic iron, although the latter is not usually preferred because its dissolution is more difficult. The ratio of the molar concentration of ferrous ions to the molar concentration of any MnO used in preparing a composition according to the invention preferably is at least, with increasing preference in the order given, 0.001:1.0, 0.003:1.0, 0.005:1.0, 0.006:1.0, 0.0070:1.0, 0.0075:1.0, 0.0080:1.0, 0.0083:1.0, or 0.0085:1.0 and independently preferably is, primarily for reasons of economy, not more than, with increasing preference in the order given, 0.50:1.0, 0.30:1.0, 0.10:1.0, 0.07:1.0, 0.05:1.0, 0.040:1.0, 0.030:1.0, 0.025:1.0, 0.020:1.0, 0.015:1.0, 0.012:1.0, or 0.0090:1.0. If hydroxylamine is used, it is preferably provided by hydroxylamine sulfate, i.e., $(HONH_3)_2SO_4$, hereinafter usually abbreviated as "HAS". Independently, if hydroxylamine is used as component (E), the ratio of the molar concentration of hydroxylamine to the molar concentration of any MnO used in preparing a composition according to the invention preferably is at least, with increasing preference in the order given, 0.01:1.0, 0.03:1.0, 0.05:1.0, 0.07:1.0, 0.080:1.0, 0.090:1.0, 0.100:1.0, 0.105:1.0, 0.110:1.0, 0.115:1.0, or 0.119:1.0 and independently preferably is, primarily for reasons of economy, not more than 1.0:1.0, 0.8:1.0, 0.70:1.0, 0.60:1.0, 0.50:1.0, 0.40:1.0, 0.30:1.0, 0.25:1.0, 0.20:1.0, 0.15:1.0, or 0.13:1.0.

Optional surfactant component (F) is often preferably present in a composition according to the invention, in order to promote thorough and uniform wetting of metal substrates to be phosphated by a conversion coating composition according to the invention. A preferred type of surfactant for conversion coating compositions according to the invention is that consisting of partial esters of phosphoric acid with ether alcohols made by condensing ethylene oxide with phenol. When used, the amount of surfactant preferably is at least, with increasing preference in the order given, 0.01, 0.03, 0.05, 0.07, 0.080, 0.085, 0.090, 0.095, or 0.099 ppt and independently preferably is, primarily for reasons of economy, not more than, with increasing preference in the order given, 1.0, 0.8, 0.6, 0.4, 0.30, 0.25, 0.20, 0.17, 0.15, 0.13, or 0.11 ppt.

Optional fluoride component (G) is normally preferred in compositions according to the invention, because it has at least three beneficial possible functions: (i) counteracting the tendency of galvanized surfaces being phosphated to develop "white specking" if the phosphating compositions contain substantial amounts of chloride, as occur in some tap water supplies; (ii) providing a buffering action to maintain the acidity of the compositions in a desirable range; and (iii) promoting a desirable rate of dissolution of the metal being phosphated, as is often necessary for the phosphating process to work. Substrates of both steel and aluminum can benefit from this latter function, and in compositions according to the invention, as is known in the art for most other phosphating processes, a concentration stoichiometrically equivalent to 100 to 300 parts per million (hereinafter usually abbreviated as "ppm") of fluorine atoms is optimum for cold rolled steel substrates, while substantially higher concentrations of fluoride are preferred if aluminum is to be conversion coated. The amount used in that instance preferably should be sufficient to avoid the well known difficulties that can be caused by accumulation of aluminum ions in phosphating compositions that do not contain any complexing agent, such as fluoride, for the aluminum ions.

Optional component (H) of divalent metal ions, except for manganese and any iron added as part of the reducing agent component (E), is not generally needed in, and therefore, at least for reasons of economy, normally is preferably omitted from, compositions according to the invention, but may be useful in some special circumstances. Optional buffering agent component (J) is often preferred in a composition according to the invention, particularly if component (G) is omitted. Borates, silicates, acetates, and the corresponding acids are suitable constituents for component (J) when desired, as are many other materials well known to those skilled in the art. Optional component (K), biocide, is usually preferably present in compositions according to the invention if substantial amounts of gluconic and/or citric acids and their salts are present in the compositions, because numerous microorganisms prevalent in normal environments can utilize these organic acids as nutrients and in the process destroy the effectiveness of the compositions for their intended use and/or make the compositions repulsive to workers who use them, for example by developing a foul odor.

Preferably make-up concentrate compositions according to this invention are single package liquid concentrates, i.e., are aqueous liquids that consist of water and each of components (A) through (K), as recited above for working compositions, that are desired in the working compositions to be prepared from the make-up concentrate compositions, along with any other ingredients desired in the working compositions, except acid or alkaline materials that are not part of any of components (A) through (K) but are added to working compositions after preparation thereof to slightly less than the final desired volume, in order to adjust the Free Acid and Total Acid contents therein as defined above. Normally, alkalinizing adjustment will be needed and if so, primarily for reasons of economy, at least one of ammonium, potassium, and sodium hydroxides is preferably used. Preferably, all the components except water of a make-up concentrate composition according to the invention are present therein in a concentration such that the ratio of the concentration of each component in the make-up concentrate composition to the concentration of the same component in the working composition that it is desired to prepare from the concentrate composition will be at least, with increasing preference in the order given, 5:1.0, 10:1.0, 20:1.0, 30:1.0, 40:1.0, or 50:1.0.

Preferably the concentrates are stable to storage in the temperature range from at least −20° to 50°, or more preferably to 80° C. Stability may conveniently be evaluated by measuring the free acid and total acid contents as described above, usually after dilution of a sample to approximately the concentration desired for a working composition. If these values have not changed after storage by more than 10% of their value before storage or by more than 0.2 points, if the absolute value before storage was less than 2.0 points, the concentrate is considered storage stable. With increasing preference in the order given, the concentrates according to the invention will be storage stable as thus defined after storage for at least 1, 3, 10, 30, 60, or 200 days.

The actual conversion coating forming step in a process according to this invention preferably is performed at a temperature that is at least, with increasing preference in the order given, 23°, 26°, 29°, 32°, 35°, 38°, 41°, 44°, 46°, 48°, 50°, 52°, 54°, or 55° C. and independently preferably is, primarily for reasons of economy, particularly for minimization of sludge volume, not more than 75°, 72°, 70°, 68°, 66°, 64°, 62°, or 61° C. The time of contact preferably should be sufficient to form a complete coating of microcrystalline phosphate over the contacted surface. When contact between a substrate to be conversion coated and a working composition according to the invention is by immersion, the time of contact preferably is at least, with increasing preference in the order given, 0.40, 0.50, 0.60, 0.70, 0.80, 0.90, 1.0, 1.3, 1.5, 1.7, or 2.0 and if maximum corrosion protective value on steel is needed still more preferably is at least, with increasing preference in the order given, 2.2, 2.4, 2.6, 2.8, 3.0, 3.5, 4.0, 4.5, or 5.0 minutes and independently, primarily for reasons of economy, preferably is not more than, with increasing preference in the order given, 15, 10, 8.0, 7.0, 6.5, 6.0, 5.7, 5.4, 5.2, or 5.0 and unless maximum corrosion protection on steel is needed from the process still more preferably is not more than, with increasing preference in the order given, 4.5, 4.0, 3.7, 3.5, 3.3, 3.1, 2.9, 2.7, 2.5, 2.3, or 2.1 minutes; when contact is by spraying, the time of contact preferably is at least, with increasing preference in the order given, 0.40, 0.50, 0.60, 0.70, 0.80, 0.90, 1.0, 1.3, 1.5, 1.7, or 2.0 minutes and independently, primarily for reasons of economy, preferably is not more than, with increasing preference in the order given, 30, 20, 15, 12, 10, 8, 7.0, 6.5, 6.0, 5.5, 5.0, 4.5, 4.0, 3.5, 3.0, or 2.5 minutes. Low times of contact are particularly preferred when the substrate surface to be coated is primarily zinciferous, because with such substrates the coating weight obtained does not increase very much after a coating that completely covers the contacted surface has been formed, whereas with steel substrates, coating weights continue to increase with time of contact, even after a coating that completely covers the contacted surface has formed.

A conversion coating formed by a process according to the invention preferably has a mass per unit area that is at least, with increasing preference in the order given, 0.4, 0.7, 1.0, 1.2, 1.5, 1.7, 1.9, 2.1, 2.3, 2.40, 2.50, 2.60, 2.70, 2.80, 2.90, or 2.97 grams per square meter of surface coated (hereinafter usually abbreviated as "$g/m^2$") and independently preferably is not more than, with increasing preference in the order given, 20, 17, 15, 13, 11, 9.0, 8.0, 7.0, 6.0, 5.0, 4.5, 4.0, 3.8, 3.6, 3.4, 3.20, or 3.10 $g/m^2$.

Before a conversion coating according to this invention is to be applied to any metal substrate, the substrate to be conversion coated is preferably thoroughly cleaned by any of various methods well known to those skilled in the art to be suitable for the particular substrate to be coated. If a conversion coating according to this invention is to be applied to a steel substrate, after being cleaned the substrate is preferably first conditioned with a conventional manganese hydrogen phosphate and alkali metal pyrophosphate conditioner for use on steel before prior art manganese phosphating. If a conversion coating according to this invention is to be applied to a predominantly zinciferous substrate such as galvanized steel, a titanium phosphate sol, also known as a Jernstedt salt, conditioning treatment is preferably used between cleaning and phosphate conversion coating according to this invention. If a conversion coating according to this invention is to be applied to a substrate containing substantial areas of both steel and galvanized steel, a mixture of the two previously specified types of conditioning treatments is preferably contacted with the substrate between cleaning and conversion coating according to the invention.

The practice of this invention may be further appreciated by consideration of the following, non-limiting examples, and the benefits of the invention may be appreciated by contrast with the comparison examples set forth below and additional comparisons known to those skilled in the art.

EXAMPLES

Group 1

General Processing Conditions

The substrates used and their abbreviations as used below are shown in Table 1.1 below. The substrates were in the form of conventional rectangular test panels.

TABLE 1.1

| Substrate Metal Type | Abbreviation | Conditioner Used |
|---|---|---|
| Cold rolled steel | CRS | PARCOLENE ® M |
| Hot dip galvanized steel | HDG | FIXODINE ® Z8 |

The processing sequence used is shown in Table 1.2. (All materials identified herein by one of the trademarks FIXODINE®, PARCO®, or PARCOLENE® are commercially available from the Parker Amchem Division of Henkel Corp., Madison Heights, Mich. and/or Henkel Metallchimie, Düsseldorf, Germany, together with directions for using them for the process steps as noted herein.)

TABLE 1.2

| Process Action | Fluid Used | Temp., °C. | Time, Sec. |
|---|---|---|---|
| Spray Primary Cleaning | 21 g/L of PARCO ® Cleaner 1502 in water | 49 | 90 |
| Spray Rinse | Tap Water | 49 | 30 |
| Conditioning | See table 1 | 20–25 | 60 |
| Phosphating | See specific examples | | |
| Spray Rinse | Tap Water | 20–25 | 30 |
| Postrinsing* | PARCOLENE ® 95A Postrinse in water | 20–25 | 30 |
| Spray Rinse* | Deionized water | 20–25 | 15 |

Footnote and Abbreviations for Table 1.2
*These steps were optional, but if used were both used.
Temp. = Temperature; Sec. = Seconds.

Concentrate Example Group 1.1

Concentrates 1.1.1 and 1.1.2 according to the invention were prepared from the ingredients shown in Table 1.3 below.

TABLE 1.3

| Ingredient | Parts of Ingredient in Concentrate #: 1.1.1 | 1.1.2 |
|---|---|---|
| Tap Water | 490 | 494 |
| 75% Aqueous Solution of $H_3PO_4$ | 350 | 350 |
| 69% Aqueous Solution of $HNO_3$ | 120 | 120 |
| Hydroxylamine Sulfate | 5.0 | 0 |
| Ferrous Sulfate Heptahydrate | 0 | 1.2 |
| Manganous Oxide | 35.0 | 35.0 |

Working Composition and Process Example and Comparison Example Group 2

An Initial Working Composition 2.1 was prepared by dissolving the following ingredients, along with whatever amount of water was needed in addition to the ingredients listed below, to produce a total volume of 10 liters: 500 grams (hereinafter usually abbreviated as "g") of Concentrate 1.1; 10 g of $MnCO_3$; 10 g of gluconic acid, 1.0 g of a surfactant constituted of partial esters of phosphoric acid, preferably with an alcohol including an aromatic portion, such as TRYFAC® 5555 or 5556 surfactants available commercially from Henkel Corp., Emery Group, Cincinnati, Ohio, RHODAFAC™ BG-510, BG-769, BX-660, PE-9, RA-600, RE-610, RE-960, RM-710, RP-710, or RS-710 surfactants, commercially available from Rhône-Poulenc, and DePhos P-6 LF, P 6-LF AS, and PE 481 surfactants commercially available from Deforest Enterprises, Inc., Boca Raton, Fla., all reported by their suppliers to consist essentially of partial esters of orthophosphoric acid with alcohols made by adduction of ethylene oxide with phenol and/or alkyl phenol; and sufficient 20% aqueous solution of sodium hydroxide to raise the pH of the final working composition to 3.8. The final concentration of manganese(II) cations was 1.89 ppt, and the points of Total Acid were 16.1. This working composition and modifications of it as shown in Table 2.1 below were used to coat rectangular CRS test panels 10×15 centimeters in size by immersion for three (3) minutes in the working composition maintained at a temperature as shown in the Table. Other process steps were the same as for Group 1.

TABLE 2.1

| Panel # | Temp., °C. | Postrinsing? | g/m² of Phos. | Notes |
|---|---|---|---|---|
| 2.1 | 65.6 | No | 5.74 | — |
| 2.2 | 54.4 | No | 2.96 | — |
| 2.3 | 54.4 | No | 2.64 | 1 |
| 2.4 | 54.4 | Yes | 2.64 | — |
| 2.5 | 54.4 | No | 4.15 | 2 |
| 2.6 | 48.9 | No | 1.40 | 2 |
| 2.7 | 54.4 | No | 5.50 | 3 |
| 2.8 | 54.4 | No | 0.43 | 4 |

Notes for Table 2.1

1. Between panels 2.2 and 2.3, 20 additional panels on which coating weights were not measured were processed to age the composition. This caused the points of Total Acid to decrease slightly to 16.0. Phosphate coatings with good visual appearance were obtained on all of these 20 additional panels.
2. Between panels 2.4 and 2.5, sufficient HAS was added to the composition in which the panels were immersed to result in a concentration of 0.25% of HAS in the composition.
3. Between panels 2.6 and 2.7, additional HAS was added to the composition in which the panels were immersed, to result in a total concentration of 0.6% of HAS in the composition.
4. Between panels 2.6 and 2.7, additional HAS was added to the composition in which the panels were immersed, to result in a total concentration of 2.0% of HAS in the composition. The very sparse phosphate coating formed appeared to be iron phosphate only, with no substantial content of manganese.

Additional Abbreviation for Table 2.1 g/m² = grams per square meter.

Working Composition and Process Example 3

A working composition was made in the same manner as for Group 2, except that the gluconic acid and manganese carbonate were omitted, the pH was adjusted to 3.75, and the points of Total Acid were 16.4. CRS test panel 3, coated at 54.4° C. for 3 minutes by immersion, had 3.07 g/m² of phosphate coating.

Working Composition and Process Examples and Comparison Examples Group 4

Concentrate 1.1 as described above was diluted to give a manganese(II) concentration of 2.5–2.8 ppt and adjusted with sodium hydroxide to give Total Acid at 29.3 points and Free Acid at 1.4 points. Test panels were coated by immersion at 65.6° C. to produce results as shown in Table 4.1. The coating obtained on panel 4.1 did not completely cover the surface, but on all other panels in Table 4.1, the coating obtained did completely cover the surface.

Example and Comparison Concentrate, Working Composition, and Process Example Group 5

Concentrates prepared for this group of examples are described in Table 5.1 below.

TABLE 4.1

| Panel Number | Substrate | Minutes Immersed | g/m² of Phosphate Coated |
|---|---|---|---|
| 4.1 | CRS | 3 | 2.70 |
| 4.2 | CRS | 5 | 3.42 |
| 4.3 | CRS | 10 | 6.51 |
| 4.4 | HDG | 3 | 3.02 |
| 4.5 | HDG | 5 | 3.02 |
| 4.6 | HDG | 10 | 3.02 |

TABLE 5.1

| Composition Number | Grams, per Kilogram of Total Composition, of: 42 °Baumé $HNO_3$ | 75% $H_3PO_4$ | $FeSO_4.7H_2O$ | MnO |
|---|---|---|---|---|
| 5.1 | 174 | 345 | 1.2 | 27.0 |
| 5.2 | 50.0 | 206 | 1.2 | 27.0 |
| 5.3 | 50.0 | 480 | 1.2 | 27.0 |
| 5.4 | 303 | 206 | 1.2 | 27.0 |
| 5.5 | 50.0 | 345 | 1.2 | 27.0 |
| 5.6 | 303 | 345 | 1.2 | 27.0 |
| 5.7 | 175 | 206 | 1.2 | 27.0 |
| 5.8 | 175 | 480 | 1.2 | 27.0 |
| 5.9 | 303 | 480 | 1.2 | 27.0 |
| 5.10 | 150 | 340 | 1.2 | 30.0 |
| 5.11 | 304 | 480 | 1.2 | 27.0 |
| 5.12 | 175 | 345 | 1.2 | 27.0 |

Notes for Table 5.1

The $HNO_3$ and $H_3PO_4$ were added in the form of aqueous solutions with the density or concentration noted in the Table headings. 42 °Baumé nitric acid contains about 69% of pure $HNO_3$. The balance of all the concentrates not shown explicitly in the Table was water.

The concentrates shown in Table 5.1 were all stable except for those numbered 5.9 and 5.11. Concentrates 5.1–5.9 were prepared so that, when diluted with water to form working compositions that contained 100 grams of concentrate per liter of working composition, the resulting working compositions would have the concentrations of nitrate and phosphate ions shown in Table 5.2 with the same number as the corresponding concentrates from Table 5.1.

TABLE 5.2

| Working Composition Number | Characteristics of the Working Compositions: Conc. in % of: $PO_4^{-3}$ | $NO_3^{-1}$ | $Mn^{+2}$ | $Na^{+1}$ | TA Points* Initial | Final | pH* Initial | Final |
|---|---|---|---|---|---|---|---|---|
| 5.1 | 2.5 | 1.15 | 0.20 | 0.80 | 30.4 | 30.0 | 3.51 | 3.48 |
| 5.2 | 1.5 | 0.33 | 0.20 | 0.31 | 20.2 | 20.0 | 3.49 | 3.47 |
| 5.3 | 3.5 | 0.33 | 0.20 | 0.50 | 43.2 | 43.4 | 3.49 | 3.47 |
| 5.4 | 1.5 | 2.0 | 0.20 | 0.92 | 19.5 | 19.3 | 3.48 | 3.42 |
| 5.5 | 2.5 | 0.33 | 0.20 | 0.54 | 31.0 | 30.8 | 3.44 | 3.41 |
| 5.6 | 2.5 | 2.0 | 0.20 | 1.15 | 31.8 | 31.4 | 3.44 | 3.39 |
| 5.7 | 1.5 | 1.15 | 0.20 | 0.61 | 19.9 | 19.7 | 3.48 | 3.43 |
| 5.8 | 3.5 | 1.15 | 0.20 | 1.06 | 41.9 | 41.6 | 3.44 | 3.40 |
| 5.9 | 3.4 | 1.9 | 0.20 | 1.40 | 39.1 | 39.1 | 3.35 | 3.26 |
| 5.10 | 2.5 | 1.0 | 0.23 | 0.38 | 24.0 | 24.0 | 3.40 | 3.30 |

Footnote, Abbreviations, and Other Notes for Table 5.2
*The last digit shown in these columns is not always significant.
"Conc." means "Concentration"; "TA" means "Total Acid".
Also, "initial" means as made up before any use, while "final" means after all processing steps described below, without any intermediate replenishing. In instances where the same composition was used more than once as indicated in other tables below, the initial and final values were averaged over all conditions of use. The variations thus averaged were never different from one another by more than a difference of five in the last digit shown in the Table. Before being used to coat test panels as reported in later Tables, each composition shown was aged by immersing in it a number of cold-rolled steel panels sufficient to correspond to 0.5 square centimeter per liter of composition; these "aging" panels were left in place for five minutes.

three-factor face centered cubic experimental design. Working Composition 5.9 was originally intended to have the highest values of both nitric and phosphoric acid concentrations to complete this experimental design, but this proved to be impossible because of instability of the composition, so that Working Composition 5.9 was prepared with the slightly lower values shown for these ingredients in Table 5.2 and proved to be stable at those concentrations. The third factor of this experimental design was immersion time, which is shown in Table 5.4 et seq.

The Working Compositions shown in Table 5.2 were used in extended processes according to the invention with features as described in Table 5.3 below. Substrates processed in this group included cold-rolled steel, double sided and single sided electrogalvanized steel, and nickel-flashed steel. The substrates used for corrosion testing were painted before testing with either DURACRON™ 200, a paint known to give relatively poor protection against corrosion on its own and therefore to be useful for discriminating among degrees of protection provided by the phosphate coating, and with a highly protective paint system of the type now commonly used on new automobiles manufactured in the U.S., to determine the maximum level of protection available from the combination of phosphating according to the invention and a highly protective organic based

TABLE 5.3

| Process Action | Fluid Used | Temp., °C. | Time, Sec. |
|---|---|---|---|
| Spray Primary Cleaning | 2.0% by volume of PARCO ® Cleaner 800 in water | On galvanized steel: | |
| | | 49 | 90 |
| | | On cold-rolled steel | |
| | | 60 | 120 |
| Spray Rinse | Tap Water | 49 | 30 |
| Conditioning* | 4.0 g/L of PARCOLENE ™ M | 20–25 | 60 |
| Phosphating | See later tables | | |
| Spray Rinse | Tap Water | 20–25 | 30 |
| Spray Rinse | Deionized water | 20–25 | 15 |

Footnote and Abbreviations for Table 5.3
*This step was included only for the cold-rolled steel substrates used.
Temp. = Temperature; Sec. = Seconds.

Working Compositions 5.1–5.8 and 5.10 as shown in Table 5.2 were prepared from corresponding Concentrates 5.1–5.8 as shown in Table 5.1 by adding to water, to produce a preliminary solution containing about 120 g/L of the Concentrate: the corresponding Concentrate; formic acid, in the form of a 90% solution in water; and GAFAC™ RP-710. The preliminary solution was then adjusted to a final volume with more water and with an aqueous solution of 50% sodium hydroxide, in an amount to contain all of the sodium required to produce the sodium concentrations shown in Table 5.2, so as to bring the final Free Acid points to a value within the range from 0.20 to 0.33, the final concentration of the Concentrate to 100 g/L, the final concentration of the formic add to 0.044%, and the final concentration of GAFAC™ RP-710 to 0.02%. Working Composition 5.9 shown in Table 5.2, which also contained formic acid and GAFAC™ RP-710 in the same concentrations as specified above for the other Working Compositions shown in Table 5.2, was prepared directly from the basic ingredients. The concentrations of nitrate and phosphate ions shown in Table 5.2 for Working Compositions 5.1 through 5.8 constitute the three variable values of two of the three factors in a overcoating of the phosphate coat, but without a chemical post-treatment of the conversion coating formed. (It is expected that still better corrosion protection would be achieved with use of a post-treatment.)

Immersion times, coating masses per unit area, and results of various corrosion tests for substrates processed by immersion in one of the working compositions described in detail in Table 5.2 are given in Table 5.4 below. Coating masses shown in Table 5.4 were determined by conventional stripping of unpainted coated samples, except for the one-sided electrogalvanized substrates, for which the coating weight were calculated based on measurements of the phosphorus content in the coatings by an ASOMA™ Model 8620 X-ray fluorescence measuring instrument supplied by Asoma Instruments, Inc., 1212-H Technology Blvd., Austin, Tex. and used as directed by its manufacturer.

Composition 5.10 from Table 5.2 was used with contact by spraying rather than immersion. Two minutes of spraying at 60° C. produced a coating with a good visual appearance.

TABLE 5.4

| | | Results with DURACRON ™ Paint | | | | | | | |
|---|---|---|---|---|---|---|---|---|---|
| | | Cold Rolled Steel Substrates | | | | Two-Sided EG Steel Substrates | | | |
| Working Composition Number | Immersion Time, Minutes | g/M² of Coating Mass | Appearance Rating, Visual/SEM | 192 Hr. SS Rating | 7 Cycle Scab Rating | g/M² of Coating Mass | Appearance Rating, Visual/SEM | 192 Hr. SS Rating | 7 Cycle Scab Rating |
| 2 | 2.0 | 0.65 | R1/3 | 3.5 | 12.3 | 1.9 | 1/1 | 3.7 | 5.6 |
| 2 | 5.0 | 2.8 | 2/1 | 1.0 | 6.0 | 1.7 | 1/2 | 2.0 | 3.3 |
| 3 | 2.0 | 0.05 | R3/5 | 2.8 | 21.3 | 2.5 | 1/2 | 3.1 | 3.5 |
| 3 | 5.0 | 2.0 | R2/1 | 1.8 | 10.3 | 2.0 | 1/2 | 3.0 | 3.1 |
| 4 | 2.0 | 2.3 | R1/1 | 1.9 | 9.9 | 1.7 | 1/1 | 3.6 | 4.1 |
| 4 | 5.0 | 3.1 | R1/1 | 2.4 | 9.2 | 1.2 | 1/2 | 3.8 | 5.9 |
| 9 | 2.0 | 0.54 | R1/4 | 3.8 | 11.4 | 2.9 | 1/2 | 3.9 | 5.4 |
| 9 | 5.0 | 2.0 | R1/1 | 2.1 | 8.6 | 2.3 | 1/3 | 2.0 | 7.4 |
| 5 | 3.5 | 1.1 | R3/1 | 3.4 | 11.2 | 1.7 | 1/3 | 1.8 | 2.9 |
| 6 | 3.5 | 2.2 | R3/1 | 2.1 | 15.3 | 1.6 | 1/3 | 2.1 | 6.0 |
| 7 | 3.5 | 2.4 | R1/1 | 4.7 | 13.8 | 1.9 | 1/2 | 2.6 | 3.7 |
| 8 | 3.5 | 1.6 | R1/1 | 2.6 | 9.7 | 2.8 | 1/2 | 2.4 | 3.4 |
| 1 | 2.0 | 1.9 | 1/2 | 2.2 | 11.5 | 2.2 | 1/2 | 3.6 | 6.1 |
| 1 | 5.0 | 2.0 | R1/2 | 2.8 | 11.1 | 1.6 | 1/2 | 3.2 | 7.0 |
| 1 | 3.5 | 1.6 | 1/2 | 2.2 | 12.3 | 1.9 | 1/2 | 3.8 | 4.8 |
| 1 | 3.5 | 2.4 | 1/2 | 3.4 | 14.3 | 2.3 | 1/2 | 3.5 | 4.6 |
| 1 | 3.5 | 1.9 | R1/2 | 2.2 | 12.3 | 1.9 | 1/2 | 3.8 | 4.8 |

| | | Results with DURACRON ™ Paint Nickel Flashed Steel Substrates | | | | Results with Auto Body Paint One-Sided EG Steel Substrates | | | |
|---|---|---|---|---|---|---|---|---|---|
| Working Composition Number | Immersion Time, Minutes | g/M² of Coating Mass | Appearance Rating, Visual/SEM | 192 Hr. SS Rating | 7 Cycle Scab Rating | g/M² of Coating Mass | Appearance Rating, Visual/SEM | 504 Hr. SS Rating | 20 Cycle Scab Rating |
| 2 | 2.0 | 1.4 | R1/4 | 3.7 | 11.7 | 1.7 | 1/2 | 0.9 | 12.6 |
| 2 | 5.0 | 3.3 | R1/2 | 1.0 | 5.8 | 4.7 | 1/4 | 1.0 | 9.2 |
| 3 | 2.0 | n.m | 1/2 | n.m. | n.m. | n.m. | n.m | n.m | n.m |
| 3 | 5.0 | 1.7 | R3/2 | 1.8 | 7.3 | 1.9 | 2/2 | 9.2 | 9.2 |
| 4 | 2.0 | 3.0 | 1/2 | 3.5 | 9.1 | 2.6 | R1/1 | 11.8 | 11.8 |
| 4 | 5.0 | 3.6 | R1/2 | 1.2 | 9.7 | 5.1 | 1/1 | 12.4 | 12.4 |
| 9 | 2.0 | n.m. | n.m. | n.m. | n.m. | n.m. | n.m | n.m | n.m |
| 9 | 5.0 | 2.7 | R1/2 | 3.6 | 12.2 | 1.2 | 1/4 | 0.9 | 8.9 |
| 5 | 3.5 | 1.6 | n.m. | 3.6 | 11.3 | 1.3 | R3/3 | 0.6 | 9.6 |
| 6 | 3.5 | 2.9 | R1/2 | 3.9 | 14.9 | 5.1 | 1/2 | 0.8 | 12.4 |
| 7 | 3.5 | 2.5 | 1/2 | 3.3 | 10.3 | 2.7 | 1/3 | 1.9 | 11.7 |
| 8 | 3.5 | 2.2 | 1/2 | 3.8 | 10.3 | 3.0 | 1/1 | 2.2 | 11.1 |
| 1 | 2.0 | 2.6 | 1/2 | 1.3 | 4.2 | 1.9 | 1/4 | 0.6 | 9.5 |
| 1 | 5.0 | 2.7 | 1/2 | 1.2 | 7.3 | n.m. | n.m. | n.m | n.m |
| 1 | 3.5 | 3.3 | 1/2 | 2.0 | 8.8 | 3.0 | 1/1 | 0.9 | 11.8 |
| 1 | 3.5 | 3.7 | R1/2 | 4.2 | 7.6 | 4.7 | 1/2 | 1.1 | 10.6 |
| 1 | 3.5 | 3.3 | 1/2 | 2.0 | 8.8 | 3.0 | 1/1 | 0.9 | 7.9 |

| | | Results with Auto Body Paint | | | | | | | |
|---|---|---|---|---|---|---|---|---|---|
| | | Cold Rolled Steel Substrates | | | | Two-Sided EG Steel Substrates | | | |
| Working Composition Number | Immersion Time, Minutes | g/M² of Coating Mass | Appearance Rating, Visual/SEM | 504 Hr. SS Rating | 20 Cycle Scab Rating | g/M² of Coating Mass | Appearance Rating, Visual/SEM | 312 Hr. SS Rating | 20 Cycle Scab Rating |
| 2 | 2.0 | 0.65 | R1/3 | 0.8 | 8.5 | 1.9 | 1/1 | 3.8 | 6.5 |
| 2 | 5.0 | 2.8 | 2/1 | 0.8 | 7.6 | 1.7 | 1/2 | 2.3 | 6.0 |
| 3 | 2.0 | 0.05 | R3/5 | 1.0 | 10.5 | 2.5 | 1/2 | 2.4 | 6.5 |
| 3 | 5.0 | 2.0 | R2/1 | 0.6 | 6.2 | 2.0 | 1/2 | 1.8 | 7.8 |
| 4 | 2.0 | 2.3 | R1/1 | 1.1 | 9.5 | 1.7 | 1/1 | 2.6 | 8.9 |
| 4 | 5.0 | 3.1 | R1/1 | 1.2 | 9.3 | 1.2 | 1/2 | 5.4 | 10.3 |
| 9 | 2.0 | 0.54 | R1/4 | 0.7 | 9.6 | 2.9 | 1/2 | 4.4 | 8.9 |
| 9 | 5.0 | 2.0 | R1/1 | 0.8 | 8.1 | 2.3 | 1/3 | 4.8 | 9.4 |
| 5 | 3.5 | 1.1 | R3/1 | 0.6 | 7.6 | 1.7 | 1/3 | 5.7 | 9.2 |
| 6 | 3.5 | 2.2 | R3/1 | 0.7 | 9.1 | 1.6 | 1/3 | 3.4 | 7.6 |
| 7 | 3.5 | 2.4 | R1/1 | 1.0 | 11.0 | 1.9 | 1/2 | 3.5 | 7.8 |

TABLE 5.4-continued

| | | | | | | | | | |
|---|---|---|---|---|---|---|---|---|---|
| 8 | 3.5 | 1.6 | R1/1 | 0.8 | 8.8 | 2.8 | 1/2 | 3.3 | 8.9 |
| 1 | 2.0 | 1.9 | 1/2 | 1.0 | 10.4 | 2.2 | 1/2 | 5.2 | 9.0 |
| 1 | 5.0 | 2.0 | R1/2 | 0.8 | 7.3 | 1.6 | 1/2 | 4.5 | 8.1 |
| 1 | 3.5 | 1.6 | R1/2 | 0.6 | 6.4 | 1.9 | 1/2 | 3.7 | 7.2 |
| 1 | 3.5 | 2.4 | 1/2 | 1.0 | 8.9 | 2.3 | 1/2 | 4.3 | 7.8 |
| 1 | 3.5 | 1.9 | R1/2 | 0.6 | 6.4 | 1.9 | 1/2 | 3.7 | 7.2. |

Abbreviations and Other Notes for Table 5.4

"$g/M^2$" means "Grams per Square meter"; "SEM" means "with a Scanning Electron Microscope"; "SS" means "Salt Spray" (according to American Society for Testing and Materials Procedure "ASTM-B-17" and the values shown in the Table are for maximum width of corroded area of the test panels away from the initial scribe, so that low values are preferred; the Scab Test was according to General Motors Procedure 9540P-B, and the values shown in the Table are for maximum width of total creep, so that low values are preferred; "Hr." means "Hours"; "n.m." means "not measured". The visual and SEM appearance ratings are reported on a scale of 1 (best) to 5 (worst). For the visual ratings, 1 corresponds to a uniform coating appearance indicative of tightly packed fine crystals, while 5 indicates a blotchy surface with void areas perceptible without magnification.

The SEM ratings were based primarily on crystal size; a rating of 1 corresponds to fine, well defined crystals, while a rating of 5 corresponds to large mottled crystals. A letter "R" in the appearance rating column indicates the presence of slight rusting on the edges of the coated samples, believed to result from finger touches during the painting process.

The invention claimed is:

1. A process for forming a conversion coating on a metal substrate surface, without the imposition of any external electromotive force on or electric current through the metal substrate, by contacting the metal substrate surface with an acidic aqueous liquid composition comprising water and:

(A) a concentration of from about 0.70 to about 3.0 ppt of dissolved divalent manganese cations;

(B) a concentration of dissolved phosphate anions, expressed in the same units as said concentration of divalent manganese cations, such that the concentration of divalent manganese cations has a ratio to the concentration of dissolved phosphate anions that is from about 1.0:30 to about 1.0:18.0, said concentration of dissolved phosphate anions being not greater than about 40 ppt; and (C) a concentration of nitric acid, said aqueous liquid composition having a temperature not more than 75° C. during its contact with the metal substrate, a Free Acid points value from about −1.5 to about 1.5, a Total Acid points value from about 4 to about 50, and a concentration of not more than 0.02 percent of each of the following constituents: zinc cations; nickel cations; calcium cations, magnesium cations, cobalt(II) cations; nitrite ions, all halate and perhalate ions; chloride ions; ferrocyanide ions, and ferricyanide ions; and said process resulting in formation of a coating with a mass of at least about 1.2 $g/m^2$ after a contact time not greater than about 5.0 minutes.

2. A process according to claim, wherein said aqueous liquid composition additionally comprises formic acid in a concentration of at least 0.15 g/L.

3. A process according to claim 2, wherein: said aqueous liquid composition comprises formic acid in a concentration that is from about 0.25 to about 1.0 g/L and that has a ratio to the concentration of nitric acid in g/L that is from about 0.002:1.0 to about 0.20:1.0; the concentration of dissolved divalent manganese cations is from about 0.70 to about 2.5 ppt; the concentration of dissolved phosphate anions is from about 7 to about 19 ppt; and the ratio of the concentration of dissolved manganese cations to the concentration of dissolved phosphate anions, with both concentrations expressed in the same units, is from about 1.0:24 to about 1.0:10.0.

4. A process according to claim 1, wherein: said aqueous liquid composition comprises formic acid in a concentration that is from about 0.25 to about 0.70 g/L and that has a ratio to the concentration of nitric acid in g/L that is from about 0.008:1.0 to about 0.010:1.0; the concentration of dissolved divalent manganese cations is from about 0.70 to about 2.3 ppt; the concentration of dissolved phosphate anions is from about 11.0 to about 17.0 ppt; and the ratio of the concentration of dissolved manganese cations to the concentration of dissolved phosphate anions, with both concentrations expressed in the same units, is from about 1.0:18 to about 1.0:12.0.

5. A process according to claim 4, wherein said aqueous liquid composition is maintained at a temperature from about 44° to about 64° C. during a contact time from about 0.50 to about 5.0 minutes and forms a conversion coating with a mass per unit area that is from about 1.9 to about 5.0 $g/m^2$.

6. A process according to claim 5, wherein: said aqueous liquid composition comprises formic acid in a concentration that is from about 0.35 to about 0.55 g/L and that has a ratio to the concentration of nitric acid in g/L that is from about 0.015:1.0 to about 0.050:1.0; the concentration of dissolved divalent manganese cations is from about 1.20 to about 2.3 ppt; the concentration of dissolved phosphate anions is from about 11.0 to about 17.0 ppt; and the Total Acid points value of the aqueous liquid composition is from about 15.0 to about 30.

* * * * *